US008826915B2

(12) United States Patent
Mehio

(10) Patent No.: US 8,826,915 B2
(45) Date of Patent: Sep. 9, 2014

(54) ADJUSTABLE HOOKAH STEM AND HOOKAH UTILIZING THE SAME

(75) Inventor: Nizar Mehio, Talet El Khayet (LB)

(73) Assignee: Mya Saray, LLC, Sterling, VA (US)

( * ) Notice: Subject to any disclaimer, the term of this patent is extended or adjusted under 35 U.S.C. 154(b) by 795 days.

(21) Appl. No.: 12/944,007

(22) Filed: Nov. 11, 2010

(65) Prior Publication Data

US 2012/0118304 A1 May 17, 2012

(51) Int. Cl.
*A24F 11/00* (2006.01)
*A24F 47/00* (2006.01)
*A24F 1/30* (2006.01)

(52) U.S. Cl.
CPC ..... *A24F 1/30* (2013.01)
USPC ..... 131/328; 131/173; 131/227; 131/174

(58) Field of Classification Search
None
See application file for complete search history.

(56) References Cited

U.S. PATENT DOCUMENTS

| | | | | |
|---|---|---|---|---|
| 253,512 | A | 2/1882 | Cole | |
| 4,116,204 | A | 9/1978 | Kline | |
| 5,875,784 | A | 3/1999 | Allison | |
| 6,568,400 | B1 | 5/2003 | Tinsky | |
| 7,287,530 | B1 * | 10/2007 | Stuart | 131/173 |
| 2006/0272658 | A1 * | 12/2006 | Mehio | 131/173 |

* cited by examiner

*Primary Examiner* — Richard Crispino
*Assistant Examiner* — Phu Nguyen
(74) *Attorney, Agent, or Firm* — Da Vinci's Notebook, LLC

(57) ABSTRACT

A hookah stem, hookah, and process for adjusting a hookah stem are disclosed. The hookah stem includes a down tube that is affixed within the hookah stem and longitudinally adjustable. The hookah utilizes the hookah stem with varying bases that may even include hookah bases with hookah base depths less than a potential plunge depth of the down tube.

15 Claims, 7 Drawing Sheets

ADJUSTABLE HOOKAH STEM AND HOOKAH UTILIZING THE SAME

FIELD OF THE INVENTION

The present invention relates to the field of wetted-smoke smoking devices and more specifically to the field of hookahs.

BACKGROUND

Of the many proud traditions of Ottoman culture, few have achieved the world-wide fame of hookah smoking. Once confined to the Middle East and Near East regions, the hookah's notoriety was invigorated by Napoleon's invasion of Egypt and the stream of curious Westerners which followed thereafter. Painters, such as Eugene Delacroix and Jean-Leon Gerome, when depicting Oriental styles typically included a hookah as a symbol of the depicted culture. The hookah was elevated from a regional curiosity to a universal symbol of sophistication.

The hookah, which has maintained a constant popularity in the Middle East, presently enjoys in American culture a unique, niched function. Hookah smoking combines community and relaxation into a single event. Rarely does one witness a group smokers crowded about a single cigarette, cigar, or pipe. Though hookahs are often designed with a single smoke outlet; the presence of multiple hoses, each capable of simultaneous use, emanating from a single smoking instrument is unique to the hookah. Multiple hose hookahs form the centerpieces of hookah clubs in which hookah smokers gather to unwind and converse with other community members. A hookah combines fashion, art, and function into a single device.

A basic hookah includes a base, a stem, at least one hose with a mouthpiece, and a bowl. The hookah bowl holds the hookah tobacco, frequently "massell." Massell is a mixture of tobacco, molasses, and often a flavor or fruit extract. The molasses and fruit extract add a substantial amount of moisture to the massell that is missing in conventional tobacco. This added moisture makes massell more sensitive to the elements relative to conventional tobacco; prolonged exposure to air evaporates much of the moisture of massell and reduces its flavor. When properly protected, massell allows a smoker a more recreational, flavored smoke than the tobacco of cigars, cigarettes, pipes, and the like. An experienced hookah smoker will know to loosely distribute massell into a pile within the hookah bowl to allow heat to evenly circulate through the pile.

The heat that ignites the massell derives from coals positioned above the hookah bowl. The coals and massell preferably never contact one to the other. A common method of placing coals proximate to the massell involves spreading a foil upon the top of a hookah bowl, punching holes in the foil, and then placing the coals onto the foil. The heat from the lighted coals travels through the holes in the foil to ignite portions of the massell. Particulates from the massell travel in the smoke created by the ignition down through the hookah bowl into the hookah pipe.

The hookah stem is the body of a hookah and is usually fabricated from brass, tin, or stainless steel. The stem transports the massell smoke from the bowl to the hookah base, which is a cavern containing water. The base of the hookah is typically fabricated of glass or plastic and tends to be the most expressive portion of the hookah, ranging from translucent to wildly-colored. Within the cavern of the hookah base, the massell smoke is cooled by the water within. The cooled massell smoke then returns to the stem, though not through the same entrance by which the massell smoke enters the base. From the stem, the massell smoke travels through the hose and out of the mouthpiece.

There are presently two prominent versions of hookah structures: the Lebanese style and the Egyptian style. Although the aficionado will explain that there are many differences between the two styles, the practical layman would quickly note the obvious difference: the connection point between the stem and the hookah bowl. The Egyptian style hookah pipe tapers upward into what is generally referred to as a male connection. The Egyptian style hookah bowl includes a female connection which receives the pipe's male connection. In the Lebanese style hookah the bowl has the tapered male connection and the pipe has the female connection to accept the Lebanese style hookah bowl. In both styles, to allow a more airtight connection a collar is generally added to fit around the male connection.

As many components of a hookah are now created to be removable, a hookah may be viewed as a modular device. A hookah stem sold with a particular hookah base may be used with that hookah base and perhaps many others. Hookah bases, however, are the primarily ornamental component of the hookah. Hookah bases are created in highly diverse shapes and sizes. The components of a hookah stem are not capable of effectively altering their dimensions to accommodate varying hookah bases. Therefore, there is a need for a hookah stem that adjusts to hookah bases of varying dimensions, a hookah capable of down tube adjustment based on liquid quantity within, and a process for adjusting the dimensions of a hookah stem.

SUMMARY

The present invention is directed to a hookah stem and hookah using the same. The hookah stem includes a body and a down tube. The body includes a sidewall that defines an interior void segmented by a transverse wall into a distal void and proximal void, each bounded by a distal aperture and proximal aperture, respectively. The transverse interior wall includes a central dry smoke channel with a channel girth. The sidewall also defines a wet smoke outlet directly adjacent to the distal void.

The down tube is affixed to the transverse wall, and may in certain embodiments be releasably affixed. The down tube includes a conduit member proximal end and a conduit member distal end and a length therebetween. The down tube slides within the channel to permit the down tube to occupy a storage position that places the distal end of the down tube, either within the distal void or in the vicinity of the distal aperture. The down tube may also slide along the channel to occupy a smoke position that places the conduit member proximal end between the storage position of the conduit member proximal end and the transverse wall.

The hookah includes the hookah stem of the present invention and a base to which the stem may affix. The hookah stem of the present invention is particularly advantageous because it may be used with a wide variety of hookah bases, including hookah bases with a depth shorter than the full plunge depth of the hookah stem down tube. That is to say if the down tube were permitted to extend to its fullest extent it would touch the bottom interior of the hookah base. Although such a configuration would normally prohibit use of such a hookah stem with that particular hookah base, the present invention permits a user simply to readjust the hookah down tube. As the hookah stem of the present invention permits use in conjunction with hookah bases of otherwise prohibitive dimensions, it is a particular feature of the present invention that the hookah stem be utilized with hookah bases with a depth less than the full plunge depth of the hookah stem down tube.

A process for regulating hookah dry smoke release into a liquid solution of a hookah base includes adjusting the hookah down tube to conform to the dimensions of a hookah base. In a preferred process, the down tube includes a plunge depth greater than the hookah base depth and the down tube is repositioned through sliding adjustment within the passage to achieve a suitable position for use with the hookah base.

Therefore, it is an aspect of the present invention to provide a hookah stem capable of use with highly variable hookah base dimensions.

It is a further aspect of the present invention to provide a hookah stem capable of simplified storage and transport.

It is a further aspect of the present invention to provide a hookah capable of simplified storage and transport.

It is a further aspect of the present invention to provide a hookah that can be created from the hookah stem of the present invention and available hookah bases.

It is a further aspect of the present invention to provide a hookah adjustable to accommodate varying liquid levels within the hookah base.

These aspects of the invention are not meant to be exclusive. Furthermore, some features may apply to certain versions of the invention, but not others. Other features, aspects, and advantages of the present invention will be readily apparent to those of ordinary skill in the art when read in conjunction with the following description, and accompanying drawings.

DETAILED DESCRIPTION

Figure 1:
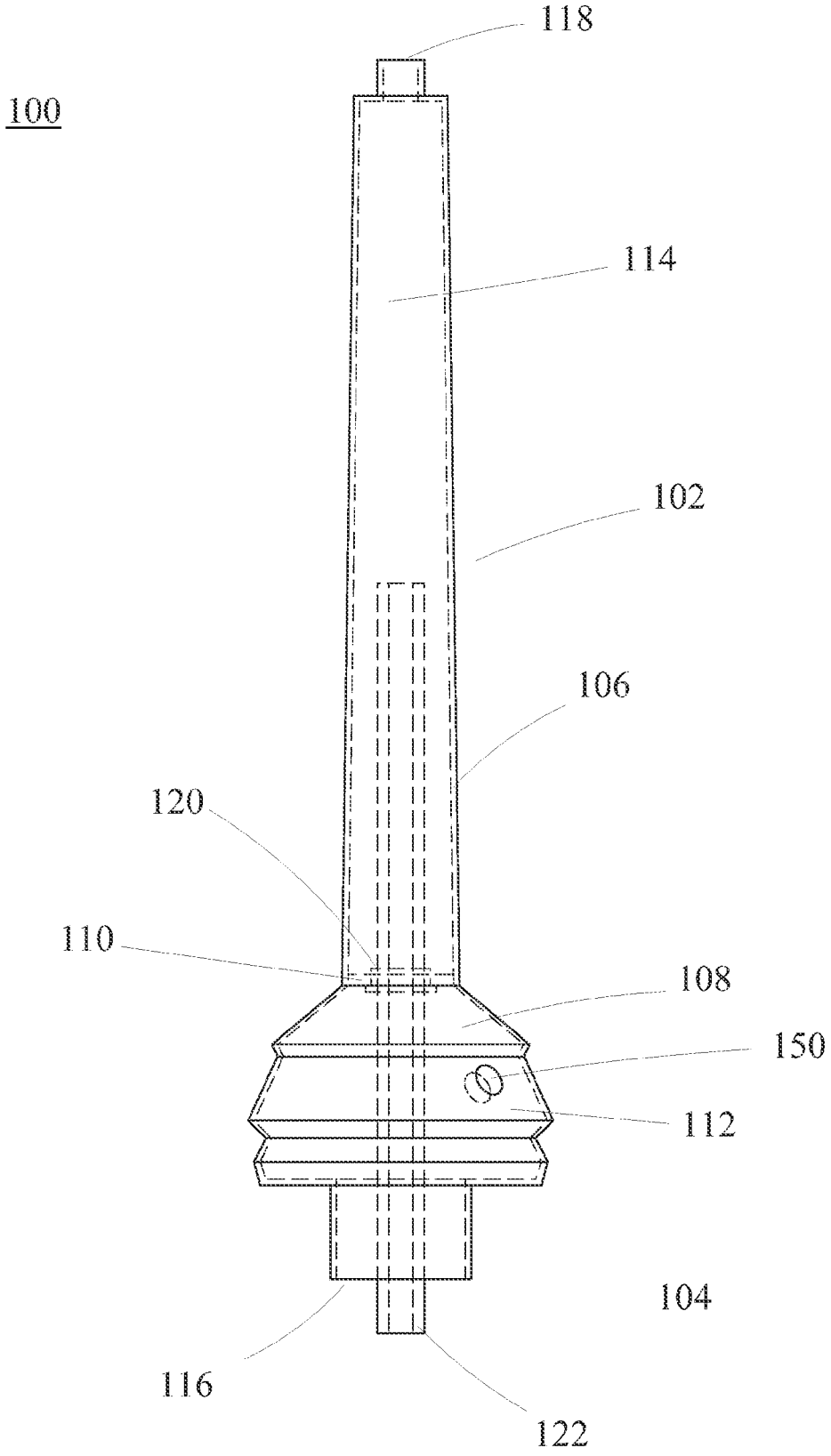
FIG. 1 is a revealed, perspective view of the hookah stem.

Referring first to FIG. 1, a basic embodiment of the hookah stem 100 is shown. The hookah stem 100 includes a body 102 and an interior down tube 104. The body includes a sidewall 106 that defines an interior void 108 segmented by a transverse wall 110 into a distal void 112 and proximal void 114. At the distal end of the body 102, the distal void 112 is bounded by a distal aperture 116. At the proximal end of the body 102, the proximal void 114 is bounded by a proximal aperture 118. The proximal aperture 118 permits the hookah stem 100 to receive dry smoke from a burner or hookah bowl and pass the dry smoke into the proximal void 114 of the interior void 108 of the body 102. From the proximal void 114 dry smoke may descend through the interior void 108, but will be prevented from direct entry into the distal void 112 from the proximal void 114 by the transverse wall 110.

The transverse wall 110 is a barrier plate that separates the proximal void 114 from the distal void 112 and provides support for the interior down tube 104. A channel 120 is formed within the transverse wall through which the down tube 104 is slidably mounted in a sealed manner. By sealed, it is meant that the down tube 104 contacts the channel 120 in a manner that prevents a substantial amount of smoke from passing from the proximal void 114 to the distal void 112 except though a conduit member 122 of the down tube 104. By slidably mounted, it is meant that the down tube 104 is affixed to the body 104, and preferably to the transverse wall 110, in a manner that permits the conduit member 122 to longitudinally move within and relative to the channel 120 to alter the longitudinal position of the conduit member 122. The affixation of the present invention may be permanent or selectively releasable at the whim of a user.

Figure 2A:
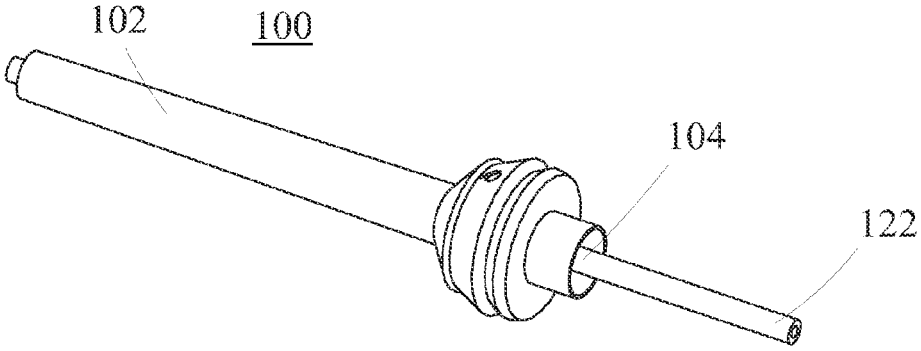
FIGS. 2A-2C are perspective views of the hookah stem.
Figure 2B:
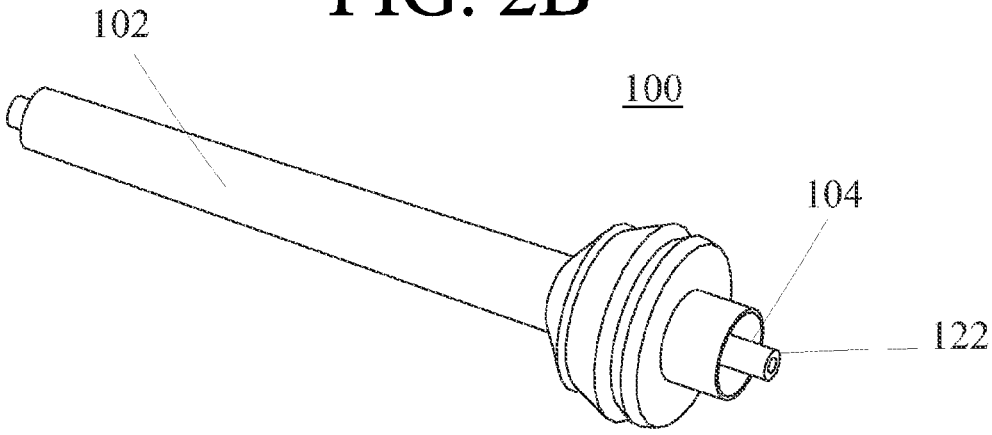
Figure 2C:
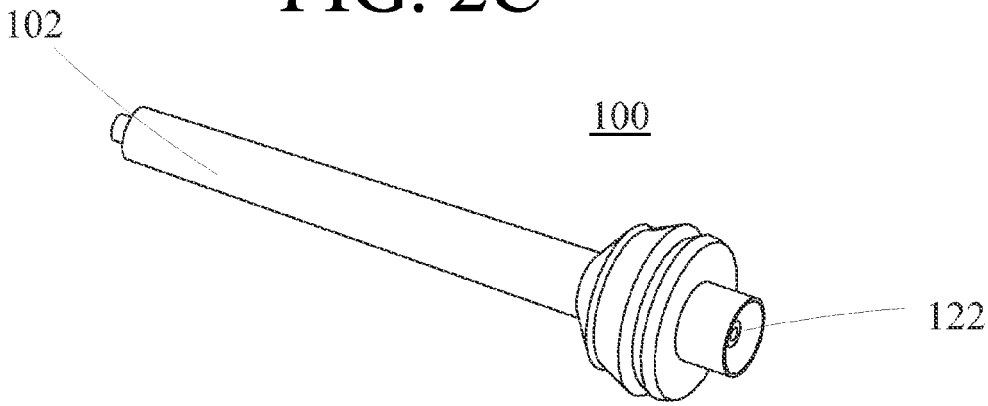
Figure 3A:
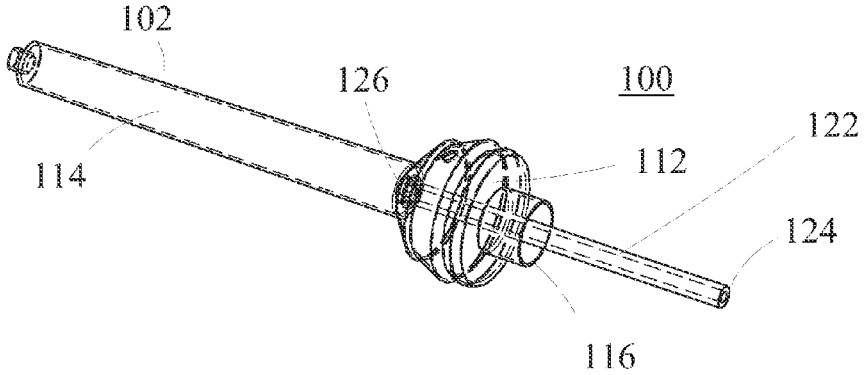
FIGS. 3A-3C are revealed, perspective views of the hookah stem.
Figure 3B:
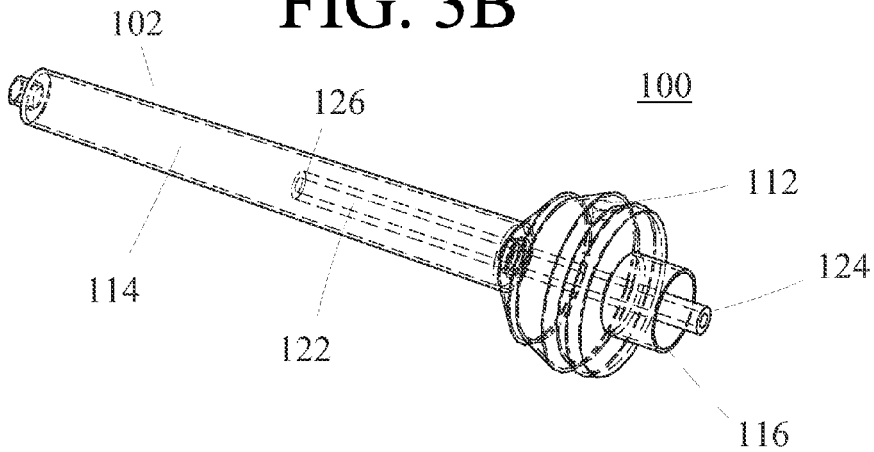
Figure 3C:
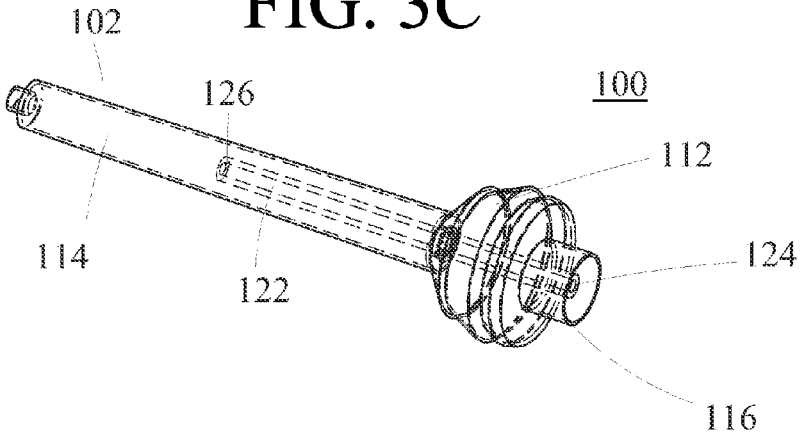

With reference to FIGS. 2A-2C and 3A-3C, exemplary positions of the conduit member 122 are depicted. By conduit member, it is meant the final, discrete component of the down tube 104 through which smoke passes from the hookah stem body 102 to a liquid within a base, or the hollow interior of that component. In certain embodiments of the present invention the conduit member 122 may constitute the only component of the down tube 104, in other embodiments of the present invention, the conduit member 122 may be one of multiple components of the down tube 104. The conduit member 122, which includes a conduit member distal end 124 and a conduit member proximal end 126, slides within the channel of the transverse wall to position the conduit member proximal end 126 in a storage position that places the conduit member proximal end substantially distant from the transverse wall as is shown in FIGS. 2C and 3C, and a smoke position that places the conduit member proximal end between its placement in the storage position and the wall. The storage position serves to retract the conduit member 122 into the body 102 of the hookah stem 100. In the storage position, the conduit member distal end 124 may be positioned entirely within the distal void 112, as depicted in FIGS. 2C and 3C, or nearby or adjacent to the distal aperture 116, as depicted in FIGS. 2B and 3B. The preferred smoke position places the proximal end 126 of the conduit member 122 adjacent to the transverse wall 100; however, the nature of the present invention is such that the smoke position will be dictated by the depth of the hookah base upon which the hookah stem rests as much as the potential plunge depth of the hookah down tube. By down tube potential plunge depth, it is meant the distance from the transverse wall to the down tube distal end when the conduit is fully extended. Otherwise the plunge depth is the distance from the transverse wall to the down tube distal end in any conduit position. It is preferred that the plunge depth permits the proximal end of the conduit member to travel approximately flush with the transverse wall. It is also preferred that the potential retraction of the conduit member permits the distal end of the conduit member to be at least adjacent to the distal aperture, and more preferably to include placement of the distal end of the conduit member within the distal void.

It is further preferred that the conduit member include a conduit member length that permits the proximal end of the conduit member to exercise a full range of motion to achieve a smoking position such that the sidewall 106 of the body 102 does not interfere with the longitudinal motion of the conduit member. The conduit member length is the measurement from the conduit proximal end to the conduit distal end. Thus the proximal void should have a proximal void length, i.e. the distance from the transverse wall to the proximal aperture, greater than the conduit member length so as to be capable of absorbing the entire length of the conduit member.

Figure 4:
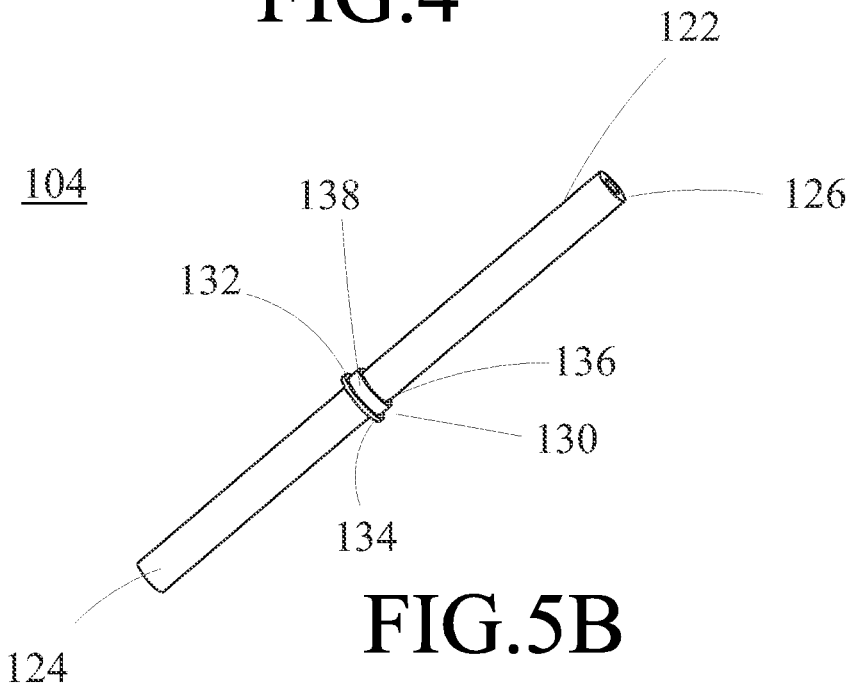
FIG. 4 is a perspective view of the down tube.
Figure 5B:
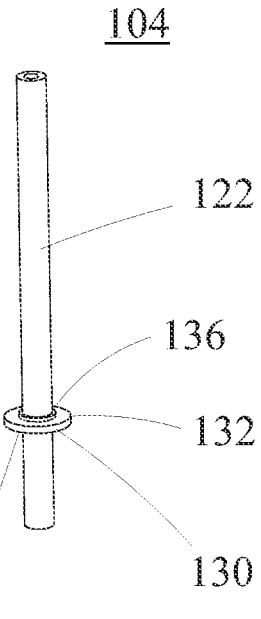
FIGS. 5A-5B are perspective views of the down tube.
Figure 5A:
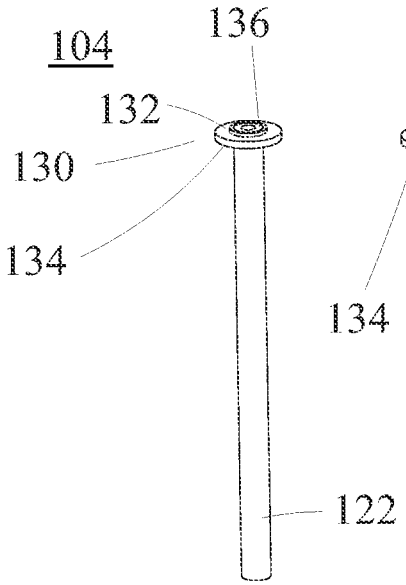

Turning now to FIGS. 4, 5A, and 5B, a preferred down tube 104 of the present invention is depicted. The down tube 104 includes the conduit member 122 and an attachment member 130. The attachment member 130 is a portion of the down tube 104 adapted to releasably affix to the transverse wall adjacent to or within the channel of the transverse wall. The preferred attachment member 130 includes an upper surface 132, a lower surface 134, and a conduit member passage 136 for the guided passage of the conduit member through the attachment member 130. The attachment member 130 may include an attachment member sidewall 138 dimensioned to sealingly mount within the channel of the transverse wall. It is preferred that when the attachment member utilizes component-fit attachment that the attachment member and transverse wall form an interference fit for the self-supported retention of the attachment member to the body of the hookah stem. An interference fit is a fit between two components wherein a first component fits within the aperture of a second component and the aperture of the second component includes a diameter smaller than the diameter of the first component in order to retain the first component within the second component. The upper surface 132 further assists in sealing the proximal void from the distal void and acts as a barrier to guide a user in the placement of the down tube within the body of the hookah stem.

FIGS. 5A and 5B illustrate the sliding passage of the conduit member 122 through the attachment member 130, and is also analogous to the passage of the conduit member through the transverse wall when no attachment member is present. In embodiments of the present invention utilizing a permanent attachment of the down tube, it is preferred that the conduit directly attach to the transverse wall; in embodiment of the present invention utilizing a selective attachment scheme, it is preferred that the conduit indirectly attach to the transverse wall through direct attachment of the attachment member. The conduit member 122 preferably fits within the attachment member via an interference fit relationship or close fit relationship. A close fit relationship for purposes of the present disclosure is a fit between two components wherein a first component fits within the aperture of a second component and the aperture of the second component includes a diameter approximately equal to the diameter of the second component in order to retain the first component within the second component. It is preferable that the close fit relationship exist between the attachment member and the conduit member and include a viscous liquid, particularly a lubricant, to assist in the retention and passage of the conduit member through the attachment member. As FIGS. 5A and 5B demonstrate, the conduit member may slide within the attachment member generally throughout the length of the conduit member.

Figure 6A:
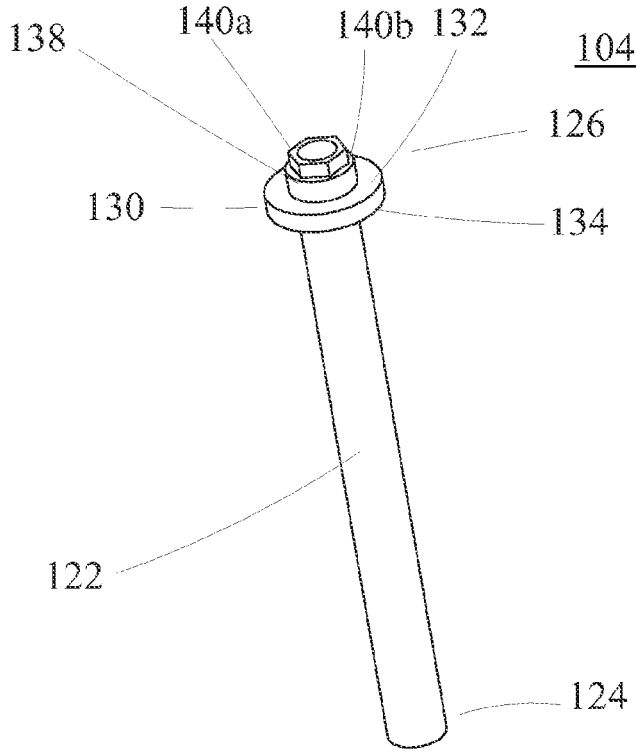
FIGS. 6A-6B are perspective views of the down tube.
Figure 6B:
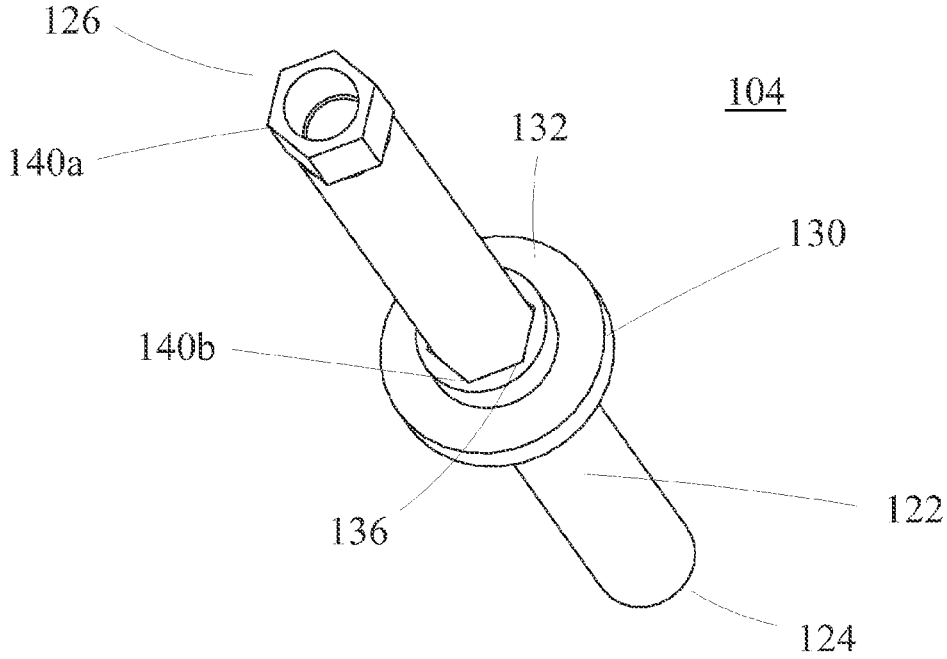

FIGS. 6A and 6B depict a preferred down tube 104 characterized by an attachment member 130 and a conduit member 122, both of which include mating lock fittings 140*a*, 140*b*. The lock fittings 140*a*, 140*b* serve to prohibit the free radial motion of the conduit member 122 relative to the attachment member 130. The preferred lock fitting 140*a* of the conduit member 122 is positioned on the proximal end 126 of the conduit member 122 and merely encompasses a small fraction of the conduit member 12. The lock fitting 140*a* of the conduit member 122 includes dimensions configured to form a close fit relationship with an upper portion of the conduit member passage 136. As pictured, the lock fitting 140*a* of the conduit member 122 includes a hexagonal nut configured to fit within a similarly sized conduit member passage 136 portion. The conduit member 122 is partially configured to form a lock fit as a hexagon, and partially configured to avoid a lock fit as a cylinder. Thus, when the cylindrical portion of the conduit member 122 is co-planar with the lock fitting 140*b* of the attachment member 130, the conduit member 122 may freely rotate radially within the conduit member passage 136. When the hexagonal portion of the conduit member 122 is co-planar with the lock fitting 140*b* of the attachment member, the conduit member may not freely rotate radially within the conduit member passage 136. Although the preferred lock fitting includes components that are partially configured for the lock fitting relationship, it is also possible to include a conduit member having a particular dimension suited for lock fitting throughout the entire length, or greater portion, of the conduit member. Similarly, the conduit member passage may include dimensions other than those described.

The lock fit permits a user a more stable means of installing and removing the down tube 104 within the body of the hookah stem. Furthermore, due to the sealed nature of the conduit member to attachment member or conduit member to channel fit relationships, potential radial motion along a substantial portion of the channel assists a user in extending or retracting the conduit member within the hookah stem. The lock fit may assist a user in affixing/removing a down tube 104 from a hookah stem in which the down tube to attachment member, or conduit member, attachment includes a close fit relationship, interference fit relationship, threaded fitting, etc. The present invention need not include merely a hookah down tube permanently affixed within the hookah stem; it is a feature of the present invention that the down tube may be selectively removable at the will of the user.

Figure 7A:
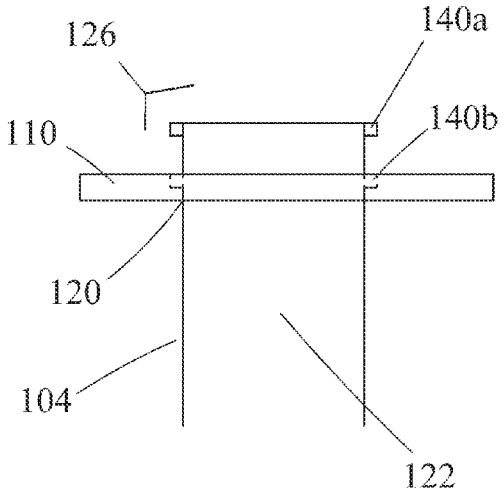
FIGS. 7A-7D are partial, sectional views of the hookah stem.
Figure 7B:
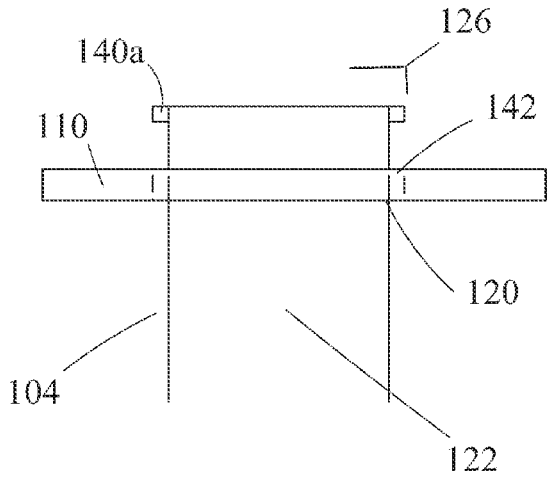

FIGS. 7A-7D show exemplary means of stable retention of the down tube 104 within the body of the hookah stem, particularly to the transverse wall 110. FIGS. 7A-7B, the lock fit of the present invention need not be merely between an attachment member and the down tube channel 120; the down tube 104 may include a lock fitting 140*a*, 140*b* between the transverse wall 110 and the proximal end 126 of the conduit member 122. In the hookah stem embodiment of FIG. 7A, the down tube 104 includes lock fittings 140*a* at the proximal end 126 of the conduit member 122. The lock fittings 140*a* include conduit member protrusions adapted to fit within the wall lock fittings 140*b* that include wall cavities. Each wall cavity is oriented to align with an equal number of conduit member protrusions such that the conduit member protrusions may rest within the wall cavities and prevent free radial motion of the conduit member 122 within the channel 120. As the cavities only partially penetrate the wall, the down tube 104 may not be removed from the hookah stem. In the hookah stem embodiment of FIG. 7B, the down tube 104 includes lock fittings 140*a* at the proximal end 126 of the conduit member 122. The lock fittings 140*a* include conduit member protrusions adapted to fit within the wall lock fittings (not shown) that include wall cavities. However, unlike the embodiment of FIG. 7A, the embodiment of 7B includes wall passages 142. Each wall passage is oriented to align with an equal number of conduit member protrusions such that the conduit member protrusions may pass through the wall passages to remove the conduit member 122 from the hookah stem.

Figure 7C:
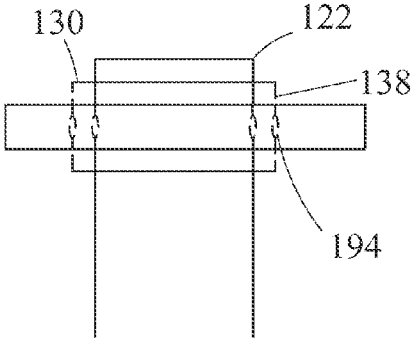
Figure 7D:
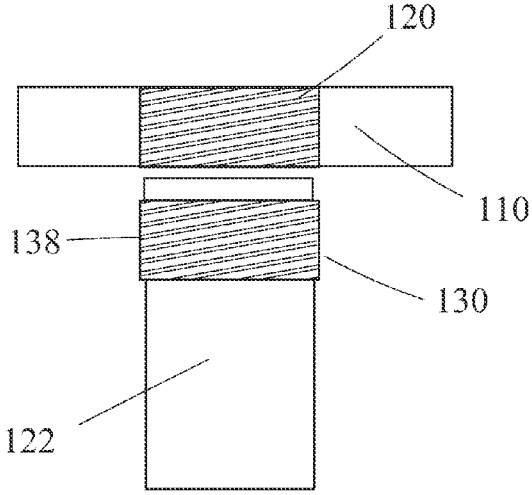

FIGS. 7C-7D show exemplary means of retaining the attachment member 130 within the channel 120 of the transverse wall 110. FIG. 7C depicts an interference fit between the sidewall 138 of the attachment member 130 and the interior of the channel 120. The interference fit may be achieved through elastic retainers 194 collapsible to allow insertion of the attachment member in the channel. Furthermore, the retainers may be used to retain the conduit member within the attachment member in an interference fit. FIG. 7*d* depicts a preferred attachment means between the attachment member 130 and the channel 120 of the transverse wall 110. The sidewall 138 of the attachment member 130 includes threading dimensioned to mate with threading within the channel 120. The threading retains the attachment member within the channel in a fashion that permits highly stable retention of the down tube 104 within the hookah stem. It is not preferred to use threading in any direct attachments between the conduit member 122 and the attachment member 130 or conduit member 122 and transverse wall. It is preferred that the conduit member, when as the sole component of the down tube or as one or multiple components of the down tube, slidably pass through the transverse wall. Slidable passage for this disclosure is passage that at least conceptually permits passage of the conduit member through the channel without the necessity of radial rotation of the conduit member.

Figure 8A:
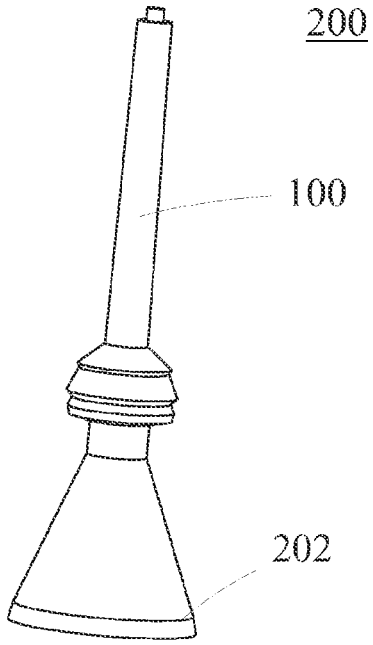
FIGS. 8A-8B are perspective views of the hookah.
Figure 8B:
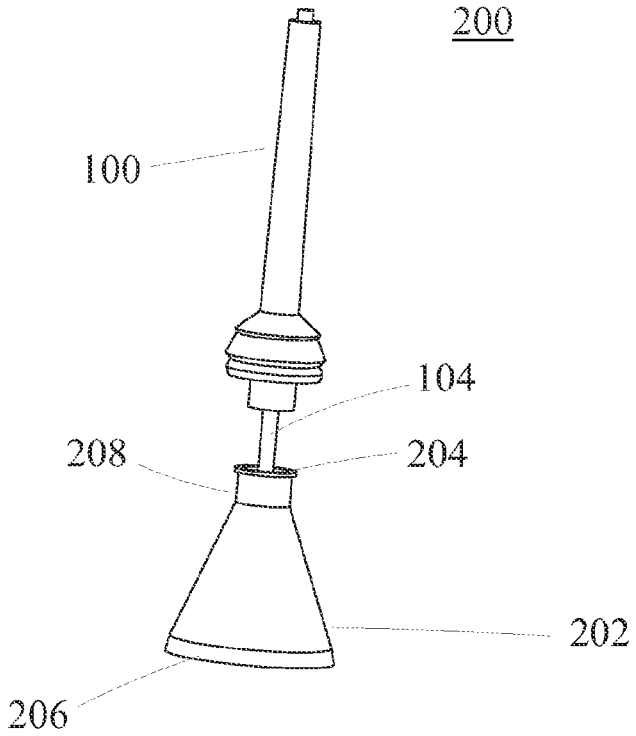

FIGS. 8A and 8B depict the hookah 200 of the present invention. The hookah 200 includes at least the hookah stem 104 and hookah base 202. The hookah 200 may further include any other hookah component or accessory for the further use of a traditional hookah including hoses, tongs, bowl, tobacco, carrying container, etc. The hookah base 202 includes a hookah base depth that is a measurement from the apex of the hookah base rim 204, i.e. the portion of the hookah base surrounding the hookah base aperture, to the hookah base interior bottom 206. Normally a hookah base may only be used with a down tube having a length less than the plunge depth of a hookah stem's down tube. With the present invention, the down tube potential plunge depth is not any material issue so long as the down tube may be maintained in a self-supporting fashion or some other accommodation is made, e.g. a down tube with a taped distal end or perforated distal end. In particular, the down tube plunge depth may be greater than the hookah base depth and thus the hookah stem 104 may be used with hookah bases 202 created specifically for it, other general hookah bases having a hookah base depth greater than the down tube plunge depth of a hookah stem, or hookah bases having a hookah base depth less than the down tube plunge depth of a hookah stem.

The present invention further includes a process for regulating hookah dry smoke release into a liquid solution of a hookah base. The process includes longitudinally adjusting a hookah down tube to conform to the dimensions of a hookah base. The down tube slibably traverses the passage from a storage position, wherein the conduit member proximal end is positioned substantially distant from the wall, to a smoke position, wherein the conduit member proximal end is repositioned between the storage position and the wall. The down tube is maintained in the smoke position, and the hookah stem is positioned upon a hookah base with the down tube positioned within the base. In a preferred process, the down tube includes a plunge depth greater than the hookah base depth and the down tube is repositioned through sliding adjustment within the passage to achieve a position with the conduit member distal end positioned between the hookah base rim 204 and the hookah base bottom 206.

Returning to FIG. 1, the hookah stem 100 is structured to permit favorable wet smoke ascension into the distal void 112. Wet smoke would ascend from a hookah base through the distal aperture 116 and to the distal void 112. It is preferred that the interior structuring of the hookah stem lack barriers to the ascension of the wet smoke such that the wet smoke does not undergo undesirable pressure alterations. In other words, the bounds of the wet smoke ascension should be defined purely by the conduit 122 and the sidewall 106 to form an annular ascension configuration. It is a theme of prior art hookahs that discrete and often winding passages exist to guide wet smoke from the extreme of a hookah stem to a wet smoke outlet. It is preferred that a wet smoke outlet 150 of the present invention directly contact the distal void rather than using one or more passages hewn within the interior of the hookah stem. Any number of wet smoke outlets 150 may be used with the present invention. The wet smoke outlet 150 is preferably positioned on the sidewall 106 between the transverse wall 110 and the distal aperture 116. It is not preferred to position the wet smoke aperture 150 above the transverse wall 110 as such would generally necessitate a discrete passage conduit to separate the wet smoke from the dry smoke occupying the proximal void 114.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A hookah stem comprising:

a body with a sidewall defining an interior void with a proximal aperture and distal aperture, said body having a transverse interior wall, with a dry smoke channel with a channel girth, spanning said void; and a down tube, affixed to said wall, having a conduit member proximal end, and conduit member distal end, and a down tube length greater than a distal void length of a distal void formed from said wall to said distal aperture, adapted to slidably, longitudinally traverse said channel to selectively position said conduit member proximal end in a storage position within a proximal void between said interior wall and said proximal aperture, wherein said conduit member proximal end is substantially distant from said wall, and a smoke position, wherein said conduit member proximal end is positioned between said storage position and said wall, wherein said sidewall defines a wet smoke outlet directly adjacent to said distal void.

2. The hookah stem of claim 1 wherein said down tube comprises a conduit member, bounded by said conduit member proximal end and said conduit member distal end, and an attachment member adapted to releasably affix to said wall proximate to said channel, said attachment member having an upper surface, a lower surface, and a conduit member passage for the guided traversal of said conduit member therethrough.

3. The hookah stem of claim 2 wherein said attachment member and said conduit member proximal end of said conduit member include mated lock fittings dimensioned to prohibit free radial motion of said conduit member within said down tube passage.

4. The hookah stem of claim 3 wherein said attachment member upper surface and said conduit member proximal end of said conduit member include mated lock fittings dimensioned to prohibit during engagement of said mated lock fittings free radial motion of said conduit member within said down tube passage.

5. The hookah stem of claim 4 wherein said attachment member upper surface and said conduit member proximal end of said conduit member include mated lock fittings dimensioned to prohibit free radial motion of said conduit member within said down tube passage.

6. The hookah stem of claim 4 wherein said conduit member proximal end includes a proximal protrusion with a protrusion girth: less than said channel girth allowing traversal of said down tube proximal end through said channel, and greater than a down tube passage girth preventing traversal of said down tube proximal end through said passage.

7. The hookah stem of claim 1 wherein said down tube and said passage form a close fit relationship dimensioned to permit said down tube to be self-supportingly positioned in said storage position and said smoke position.

8. The hookah stem of claim 7 wherein said down tube and said passage form an interference fit relationship dimensioned to permit said down tube to be self-supportingly positioned in said storage position and said smoke position.

9. The hookah stem of claim 7 wherein said down tube comprises a conduit member, bounded by said conduit member proximal end and said conduit member distal end, and an attachment member adapted to releasably affix to said wall proximate to said channel, said attachment member having an upper surface, a lower surface, and a conduit member passage for the guided traversal of said conduit member therethrough.

10. The hookah stem of claim 9 wherein said attachment member and said proximal end of said down tube include mated size fittings dimensioned to prohibit substantial radial motion of said down tube within said down tube passage.

11. The hookah stem of claim 10 wherein said attachment member and said conduit member proximal end of said conduit member include mated lock fittings dimensioned to prohibit free radial motion of said conduit member within said down tube passage.

12. The hookah stem of claim 11 wherein a proximal void length of said proximal void formed from said wall to said proximal aperture is greater than said down tube length.

13. The hookah stem of claim 1 wherein a proximal void length of said proximal void formed from said wall to said proximal aperture is greater than said down tube length.

14. The hookah stem of claim 1 wherein said down tube proximal end is positioned between said wall and said proximal aperture and includes a proximal protrusion with a protrusion girth greater than said channel girth preventing traversal of said down tube proximal end through said channel.

15. A hookah stem comprising:

a body with a sidewall defining an interior void with a proximal aperture and distal aperture, said body having a transverse interior wall, with a dry smoke channel with a channel girth, spanning said void; and a down tube, affixed to said wall, having a conduit member proximal end, and conduit member distal end, and a down tube length greater than a distal void length of a distal void formed from said wall to said distal aperture, adapted to slidably, longitudinally traverse said channel to selectively position said distal end of said down tube in a storage position in said distal void and a smoke position beyond said distal aperture, wherein said sidewall defines a wet smoke outlet directly adjacent to said distal void.

* * * * *